US008764372B2

(12) United States Patent
Fletcher et al.

(10) Patent No.: US 8,764,372 B2
(45) Date of Patent: Jul. 1, 2014

(54) COMPACT WHEELCHAIR PLATFORM

(75) Inventors: Richard Fletcher, Brighton (GB); John Godwin Walters, Brighton (GB)

(73) Assignee: Design Specific Ltd., Hove (GB)

( * ) Notice: Subject to any disclaimer, the term of this patent is extended or adjusted under 35 U.S.C. 154(b) by 192 days.

(21) Appl. No.: 13/376,313

(22) PCT Filed: May 27, 2010

(86) PCT No.: PCT/GB2010/001046

§ 371 (c)(1),
(2), (4) Date: Feb. 2, 2012

(87) PCT Pub. No.: WO2010/139935

PCT Pub. Date: Dec. 9, 2010

(65) Prior Publication Data

US 2012/0121370 A1 May 17, 2012

(30) Foreign Application Priority Data

Jun. 3, 2009 (GB) ..... 0909522.5

(51) Int. Cl.
*A61G 5/00* (2006.01)
*A61G 7/10* (2006.01)

(52) U.S. Cl.
USPC ..... 414/678; 254/3 R

(58) Field of Classification Search
USPC ..... 108/147, 6, 7, 9; 248/393, 396, 397; 254/122, 9 C, 3 B, 3 C, 3 R, 8 C; 269/71; 280/43.24, 641; 297/344.13, DIG. 10, 297/DIG. 4; 414/421, 540, 642, 652, 678, 414/743, 754, 767, 768, 769, 770, 771, 775, 414/778, 779, 780, 784, 921, 546
See application file for complete search history.

(56) References Cited

U.S. PATENT DOCUMENTS

| | | | | | |
|---|---|---|---|---|---|
| 2,667,279 | A | * | 1/1954 | Fishburne et al. | 414/362 |
| 3,075,652 | A | * | 1/1963 | McCoy | 414/795.9 |
| 3,220,584 | A | * | 11/1965 | Swanson | 414/420 |
| 3,651,965 | A | * | 3/1972 | Simonelli et al. | 414/540 |
| 3,750,810 | A | * | 8/1973 | Stanfill | 414/421 |
| 4,192,549 | A | | 3/1980 | Petersen | |
| 4,527,944 | A | | 7/1985 | Qually et al. | |
| 4,561,823 | A | | 12/1985 | Norton | |
| 4,725,188 | A | | 2/1988 | Zimmermann et al. | |
| 4,790,716 | A | | 12/1988 | McConnell | |
| 5,040,939 | A | | 8/1991 | Booth | |

(Continued)

FOREIGN PATENT DOCUMENTS

| | | |
|---|---|---|
| DE | 29817078 | 12/1998 |
| EP | 127310 | 12/1984 |
| GB | 2416345 | 1/2006 |
| WO | WO 01/82853 | 11/2001 |

*Primary Examiner* — Gregory Adams
(74) *Attorney, Agent, or Firm* — Diederiks & Whitelaw, PLC

(57) ABSTRACT

A wheelchair platform comprises a tilting platform for a wheelchair comprising a base to support the wheelchair in use and a back wall. The platform is pivotably connected between a pair of side supports in a compact construction. Actuators, such as hydraulic rams are operable to tilt the platform. The pivot axis for the platform is forward of the back wall and above the base. The actuators are also forward of the back wall. The platform swings forward when tilting. The base may be hinged approximately half way along its length to allow the front half to be folded over for storage.

13 Claims, 4 Drawing Sheets

(56) References Cited

U.S. PATENT DOCUMENTS

| | | | | |
|---|---|---|---|---|
| 5,449,267 | A * | 9/1995 | Ablabutyan | 414/540 |
| 5,472,307 | A | 12/1995 | Kadlec et al. | |
| 5,755,816 | A * | 5/1998 | Schirmer et al. | 414/768 |
| 5,890,869 | A | 4/1999 | LeMaster et al. | |
| 5,944,473 | A * | 8/1999 | Saucier et al. | 414/546 |
| 6,478,529 | B1 | 11/2002 | Willey et al. | |
| 6,533,073 | B2 * | 3/2003 | Chernik et al. | 186/66 |
| 7,445,416 | B2 * | 11/2008 | O'Leary et al. | 414/546 |
| 2006/0048310 | A1 | 3/2006 | Tin et al. | |
| 2007/0183879 | A1 * | 8/2007 | Corcuera | 414/546 |

* cited by examiner

COMPACT WHEELCHAIR PLATFORM

CROSS-REFERENCE TO RELATED APPLICATIONS

This application represents a National Stage application of PCT/GB2010/001046 entitled "Compact Wheelchair Platform" filed May 27, 2010, pending.

BACKGROUND OF THE INVENTION

The invention relates to a wheelchair platform, particularly to a compact wheelchair platform.

Wheelchair platforms are used by medical personnel, for example in dental surgeries, to assist in the clinical treatment of wheelchair users. Typically a wheelchair is wheeled onto the platform as far as a back wall will allow and the wheelchair brake is applied. A backrest and headrest assembly supports the person in the wheelchair. The platform can be tilted backwards to set the patient's head, or feet, into a good treatment position for, say, dental or podiatry procedures. The patient remains in his own wheelchair at all times, eliminating manual handling and hoisting.

Wheelchair platforms may also be used for facial work as part of a medical or cosmetic procedure. They may even be used to tilt back a wheelchair user to facilitate hair washing and hairdressing.

An example of a wheelchair platform optimally designed for clinical use is the Full Function Wheelchair Platform available from Design Specific Limited. This wheelchair platform provides a rise and fall function in addition to a tilting function so the wheelchair user can be placed at the perfect height for e.g. a medical professional to work in comfort, while also ensuring patient comfort at all times. Because the platform is installed into the floor of a room it may not be suitable for every situation.

There is also available from Design Specific Limited a Standard Wheelchair Platform which does not require permanent installation and which can tilt a wheelchair back to a maximum angle of 45°. This typically puts a patient's head at a height of 80 cm from the floor, which is low enough for normal seated working. Although it may be desirable in some circumstances for the patient to be tilted further back, the angle of tilt is limited to 45° so as to ensure the stability of the platform. In this situation a clinician may instead use a pump-up stool to attain the required working height above the patient.

The stability of existing powered wheelchair platforms when fully reclined is always an issue. All the currently available powered wheelchair platforms have a support base to which the tilting platform is operatively connected. This support base is often called a chassis. The chassis provides a large stabilising footprint on the floor and helps to ensure that the overall centre of gravity is always towards the front of the wheelchair, even when it is tilted back. Stabilising feet may also be deployed behind the platform.

In the Diaco® dental chair, stabilisation is further ensured by disposing the pivot means for the platform rearward of the back wall of the platform and spaced apart from it. In this product the hydraulic rams which lift the platform are mounted between the chassis and the platform, behind the back wall of the platform and forward of the pivot means. Even when the platform is tilted back to the maximum angle of 50° from the chassis, the centre of gravity of the wheelchair and user remains far forward of the pivot axis. A retractable stabilizer arm rearward of the pivot axis can be lowered into contact with the ground for additional stabilisation, especially at large tilting angles.

While stabilising arms, and feet rearward of the platform may be retractable, the Applicant has realised that a stabilising chassis beneath the wheelchair platform can represent a large and heavy structure which takes up space and can limit the transportability of the apparatus. There remain issues with the size and weight of wheelchair platforms. Particularly in clinical environments, space can be at a premium.

SUMMARY OF THE INVENTION

When viewed from a first aspect the present invention provides a wheelchair platform comprising a tilting platform for a wheelchair comprising a base to support the wheelchair in use and a back wall, said platform being pivotably connected between a pair of side supports, and actuating means operable to tilt the platform, wherein the pivot axis for the platform is forward of the back wall and above the base, and wherein the actuating means is forward of the back wall.

Thus in accordance with the invention the pivot axis for the platform is provided forward of the back wall of the platform, together with the platform base projecting forward from the back wall, and higher than its base. This means that as the base of the platform is tilted back from an initial horizontal position, a lower part of the back wall actually swings forward beneath the pivot axis. The effect is that the centre of gravity of the platform, with the load of the person sat in the wheelchair, is kept forward of the back wall. During tilting of the platform the centre of gravity preferably moves within a limited horizontal range about the pivot axis. The platform and its user is cradled about the pivot axis.

As the pivot axis is provided forward of the back wall of the platform and raised above the base of the platform, it passes through the wheelchair and its user parked on the base. The wheelchair user therefore feels less of the tilting movement, for example as compared to systems where the platform pivots about a point rearward of the backwall. This helps the wheelchair user to feel secure. A further advantage is that the user can shift his or her weight in the wheelchair in a tilted position of the platform and not feel a disturbing shift in his or her centre of gravity. The platform is therefore more comfortable in use.

The Applicant has appreciated that there is a further advantage to positioning the pivot axis for the platform forward of the back wall and above the base of the platform. As the weight of the wheelchair and user is generally kept forwards, the wheelchair platform is more stable overall. The location of the pivot axis provides the apparatus with a degree of self-stabilisation. This means that the need for a stabilising chassis under the platform is reduced. The wheelchair platform can therefore be made lighter and more compact.

Moreover the Applicant has appreciated that these advantages are enhanced when the actuating means for the tilting motion is also positioned forward of the back wall of the platform, i.e. adjacent the base of the platform. This further increases stability as the weight of the actuating means, which can represent a substantial fraction of the overall weight, is concentrated through the same floor area as the weight of the tilting platform. Furthermore this helps to make the apparatus compact, for example as compared to wheelchair platforms which have the actuating means behind the back wall of the platform. The wheelchair platform may therefore take up less floor space in operation as well as being easier to store. This can be particularly important in clinical environments where there may be multiple pieces of medical equipment in the room and the medical personnel need plenty of space to circulate.

The Applicant has realised that the actuating means can be positioned so as to maximise the space-saving layout of the machine. Preferably there is provided a pair of actuating means, one at or in each of the side supports. The actuating means can therefore contribute to the weight of the side supports, which provide a stable frame for the pivotally mounted platform therebetween. With such an arrangement there is even less of a need to provide a supporting chassis which passes beneath the base of the platform. The two side supports alone can provide a stable footprint on the floor. Without a chassis the base of the platform may be lowered closer to the floor. Furthermore the weight of a conventional support chassis can be removed so the apparatus is lighter and easier to transport.

Embodiments of the present invention therefore provide a more compact wheelchair platform with the main components clustered around the platform itself, preferably at the sides of the platform. The position of the pivot axis and of the actuating means promotes self-stabilisation so that a supporting chassis extending beneath the base of the platform is not necessarily required for stabilisation. The wheelchair platform can comprise fewer parts and be made smaller and lighter than known models.

Although a supporting chassis extending beneath the platform is not necessary when the advantages of the present invention are fully realised, it may be desirable at least in some embodiments to provide some kind of base plate or strut connecting the side supports. This can help to keep the side supports at a fixed separation and provide the platform with a more rigid framework. However, it will be appreciated that any base below the platform can be made relatively light as it does not have to provide a stabilising weight as in known apparatus. Preferably there is provided at the base between the side supports at least a sleeve to guide and contain connections between the side supports such as pneumatic air supplies and/or electrical wires. Preferably any structure provided between the side supports has a footprint which is the same size or preferably smaller than the base of the platform. It will therefore take up less floor space than a conventional chassis.

As mentioned above, it is preferable that the pivot axis for the platform is positioned such that in use the centre of gravity of the tilting platform with its wheelchair load moves within a limited range laterally of the pivot axis. Preferably the platform can be tilted by up to 45°, more preferably up to 50°, further preferably up to 60° and most preferably up to 70° from the horizontal. The increased stability of the apparatus therefore allows for a larger range of tilting movement than is usually possible in currently available wheelchair platforms. The increased range of tilting angles may also mean that a person working on the wheelchair user does not have to adjust the height of his stool.

Tilting angles up to 70° are also advantageous as this allows for the provision of a recovery position wherein a patient's body and legs are placed higher than the patient's head to encourage blood flow. For example, when treating a dental patient the tilt angle may be 45-50° during normal use with an angle of up to 60 or 70° reserved for recovery and resuscitation.

The actuating means could be provided below the base of the platform so as to minimise the lateral space taken up in addition to the footprint of the platform itself. However, this may require the base of the platform to be raised above the floor with ramping required to manoeuvre a wheelchair on to the platform. Or the base of the platform may need to be shaped, e.g. with a recess, to accommodate the actuating means. As mentioned above, it is therefore preferred that the actuating means is positioned at the side(s) of the platform, preferably within the side support(s). This is advantageous as it means that the actuating means is not taking up any space beneath the platform. At least part of the base of the platform may therefore be arranged to contact the floor in its lowered position without any need to accommodate the actuating means. This maximises the range of movement of the platform and gives design freedom.

The actuating means can be any mechanical or electromechanical device capable of providing a force to tilt the platform. For example, lever arms, telescopic rods, lifting jacks or cams may be used. The actuating means may be manually operable but preferably it is electrically controlled, for example using an electric motor, for ease of operation by both clinicians and patients. A preferred actuating means comprises a hydraulic ram. A hydraulic actuating means advantageously provides a smooth motion and quiet operation. A control pad for the hydraulics may be provided on one of the side supports for easy access. A remote control is also preferably provided, e.g. a radio frequency controller. The actuating means can be mains or battery operated. A rechargeable battery may be used.

In order to help keep the apparatus compact, and for ease of cleaning, each actuating means e.g. hydraulic ram is preferably provided within one of the side supports. It is further preferred that the actuating means do not extend outside the side supports, even during operation. The hydraulic pump is preferably located within the back wall of the platform. One or more batteries may also be provided within the back wall of the platform. The actuating system is therefore fully enclosed.

In some currently available products the actuating means, such as hydraulic rams, are located behind the back wall of the wheelchair platform so that there is space for the ram to extend and push the platform up about its pivot. In other products a hydraulic ram is provided beneath the base of the platform, again with space for the ram to extend so as to push up the platform from below. A hydraulic piston will provide more power when pushing as it has the full volume of fluid behind the ram. However the Applicant has realised that the space required by a hydraulic actuator in operation may be reduced by preferably arranging for the ram to move from an extended position when the platform is lowered to the floor to a retracted position when tilting the platform up from the floor. In other words the hydraulic actuator is arranged to pull the platform round its pivot rather than to push. This is in complete reverse to conventional hydraulic operation.

This feature is both novel and inventive in its own right, regardless of the position of the platform's pivot axis, and thus when viewed from another aspect the present invention provides a wheelchair platform comprising a tilting platform for a wheelchair, said platform being pivotably connected between a pair side supports, and hydraulic actuating means operably connected to the platform such the platform is tilted up from a horizontal position when the actuating ram is retracted from an extended position.

According to this arrangement the hydraulic actuator is preferably fully extended when the platform is horizontal, i.e. in the machine's default and storage position, and then retracted when the machine is operating to tilt the platform. This means that the actuator takes up less space in operation rather than more, as is the norm. This helps to keep the apparatus compact at all times.

In order to increase the power available from the hydraulic actuator when the ram is being pulled back into the cylinder, preferably the diameter of the ram is made small compared to the diameter of the cylinder, so as to maximise the annulus of fluid around the ram. A thinner ram than usual may therefore be used.

The preferred features of an actuating means described above are equally applicable to this aspect of the invention. For instance, it is preferred that the hydraulic actuating means comprises a pair of actuating rams. Each actuating ram is preferably positioned such that in its extended state it fits within one of the side supports. Thus during operation the ram retracts into its cylinder inside the side support. In a preferred embodiment the hydraulic rams are operably connected to a back wall of the platform. In order for retraction of the rams to tilt the platform, the rams are preferably located forward of the back wall and below the pivot axis. As the rams retract, the back wall is pulled forward beneath the pivot so that the base of the platform swings up. The result is a cradling motion around the pivot.

Preferably the wheelchair platform is mobile, for example using wheels or an air cushion to ride across the floor. This allows the platform to be moved to one side of a room when not in use, or transferred between different rooms. It also facilitates movement of the platform for cleaning, which is especially important in a clinical environment. However the issue of storage whilst not in use remains a problem, whether the platform is mobile or not. The Applicant has devised a unique solution to this problem. In order to reduce the space taken up by the apparatus when not in use, it is preferred that at least a portion of the tilting platform, in particular the platform base, is hinged so as to allow the platform to be folded when not in use.

This feature is both novel and inventive in its own right and thus when viewed from a further aspect the present invention provides a wheelchair platform comprising a pivotably mounted platform for a wheelchair, wherein at least a portion of the platform is hinged so as to allow the platform to be folded when not in use.

Accordingly the platform may be folded up into a compact unit which may then be stored under a worktop or other surface. The folded unit may also be easier to transport and manoeuvre through doors and into small spaces. It should be understood that what is meant by a hinged portion of the platform is a portion of the platform which supports a wheelchair in use, in other words a portion of the load-bearing base of the platform is hinged, rather than a ramp portion attached to the base which is folded up and down only to help wheelchair entry to the platform. Such a ramp portion does not support any of the weight of the wheelchair and its user when the platform is in use.

Preferably the base of the platform is hinged such that it can be folded back on itself. This can greatly reduce the footprint of the machine, for example to an area smaller than that normally taken up by a wheelchair. This is a much larger space-saving than can be achieved merely by providing a hinged ramp portion.

All of the preferred features described hereinabove apply equally to this further aspect of the invention. In particular, it is preferred that the folding construction is used in a compact wheelchair platform which comprises a pair of side supports with the platform pivotably connected therebetween and actuating means, such as hydraulic rams, provided within the side supports. Preferably there is no chassis beneath the platform. The overall size of the apparatus is therefore likely to be dependent on the size of the platform itself. Even if a base plate or struts are present between the side supports, they preferably present a smaller footprint than the platform. Folding of the platform therefore provides a space saving which is not possible in wheelchair platforms having a large chassis which extends over the same area of the platform, for example to provide a supporting footprint when the platform is tilted back.

As is described above, unlike known wheelchair platforms there may not be any supporting chassis and/or actuators at least provided behind the platform. Preferably the side supports do not extend behind the back wall of the platform when in the horizontal position. It is also preferable that the side supports only extend along a portion of the base of the platform. The side supports may only extend along about 30%, 40%, 50%, 60% or 70% of the length of the base. The space taken up by the apparatus is therefore preferably dictated by the platform itself.

As mentioned above, the hinged portion of the platform is preferably a portion of the platform base. The hinged base portion may represent about 30%, 40% or 50% of the area of the base. Preferably the base is hinged about halfway along its length, alternatively up to ⅔ of its length forward of the back wall, so as to allow between ⅓ and half of the base to be folded over when the platform is not in use. Preferably the hinge in the base is arranged to coincide with the forward end of the side supports. The forward portion of the base may therefore be folded over into the area between the side supports to minimise the size of the machine. Preferably the forward portion of the base can be pivoted over to rest the front edge of the platform base on a rear portion of the platform base.

The platform base may comprises means for locking the hinged portion in its open and/or folded configuration. This can provide stability when the base is opened out ready to receive a wheelchair, and safety when the base is folded over for transport, storage, etc.

The back wall may itself comprise a hinged portion. However, it is preferred that a back and/or head rest assembly is pivotally connected to the back wall of the platform so as to allow the assembly to fold down on top of the folded base. For example the assembly may comprise a hinged head rest portion and a hinged back rest portion. Alternatively or additionally, the head rest and/or back rest may be removable. However, to facilitate deployment of the wheelchair platform it is preferred that the hinged portion(s) can be simply folded up and down. The hinged portion(s) of the back/head rest assembly may also be locked into position.

Some further preferred features in accordance with embodiments of all aspects of the invention will now be described.

Access to a wheelchair platform is normally achieved by directly rolling the wheelchair backwards onto the platform base, possibly using a ramp to gain access to the platform. The platforms on current models all have parallel side walls which restrict wheelchair access to a straight line. It is a preferred feature that the platform base is wider at its front end than at the rear. Preferably the platform has a flared base profile. Any side walls will therefore curve outwardly towards the front of the base. This allows for easier access of the wheelchair to the platform. A curved trajectory for access to the platform is possible.

Although rear stabilisers may not be necessary for low wheelchair loads and/or small tilting angles, one or more stabilising arm(s) are preferably connected at the rear of the side supports. The stabilising arm(s) may be retractable, for example being rotatable relative to the side supports to come into contact with the floor behind the platform. They can help to prevent the apparatus from tipping over as the platform is tilted back.

The movement of mobile wheelchair platforms within a clinic space has been tackled in several ways. Wheeled devices have been extensively used and air hover support of some form is common. However, wheels do not package well on the product and hover solutions are heavily dependent on the type of flooring used. Modern non-slip floors present resistance to movement using an air cushion.

According to a preferred feature of the present invention the wheelchair platform is provided with castors, preferably ball castor units. Preferably the ball castor units are retractable. This means that the platform may be lowered completely into contact with the floor for stability when the platform is in use. The wheelchair platform preferably comprises means for providing and releasing compressed air for raising and lowering the apparatus. When the ball castors are lowered, the wheelchair platform can be moved in any direction, unlike a wheeled device. Movement of the wheelchair platform is also facilitated by its light and compact construction.

The needs of hygiene are of significant importance in a clinical setting. Where, as is preferred, the actuating means are provided within the side supports, the working mechanism is preferably enclosed. The other operational components such as hydraulic pump, batteries, etc. are preferably provided in a cavity in the back wall of the platform. The wheelchair platform is therefore easy to clean and more hygienic than machines which have exposed working parts, such as hydraulic rams behind or below the platform. For the same reasons it is preferred that the platform is made from sheet metal, preferably with a sintered powder coating. The platform may be formed from an L-shaped piece of sheet metal so as to minimise the number of parts and surfaces which can harbour bacteria. A single hinged portion may be provided in the platform base so to reduce the potential for dirt collection in the hinge.

BRIEF DESCRIPTION OF THE DRAWINGS

A preferred embodiment of the present invention will now be described, by way of example only, and with reference to the accompanying drawings, in which.

DETAILED DESCRIPTION OF THE INVENTION

Figure 1:
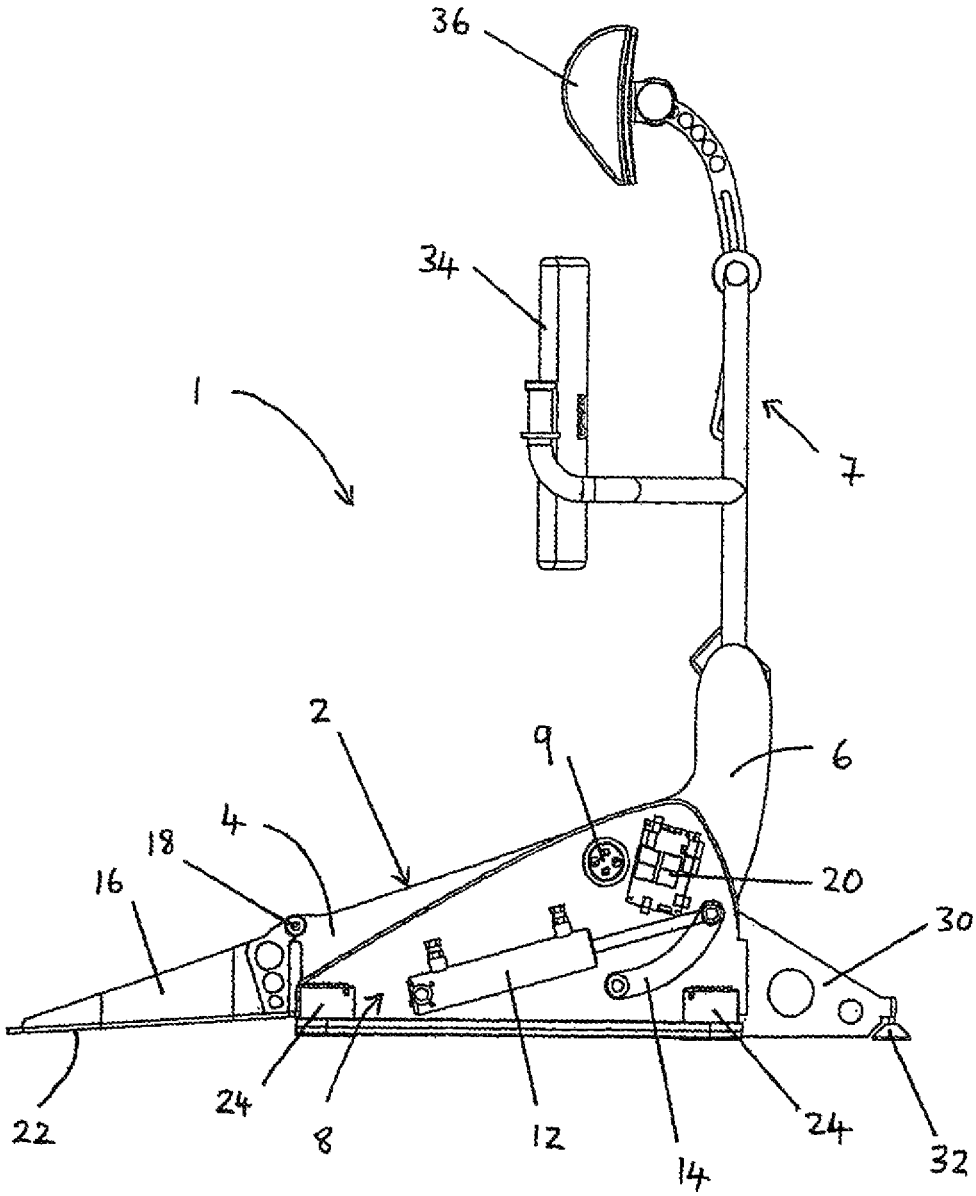
FIG. 1 is a side view of a wheelchair platform according to the preferred embodiment in a loading position.

There is shown in the Figures a wheelchair platform 1 comprising a tilting platform 2 which supports a wheelchair in use (not shown). Referring to the loading position of the platform shown in FIG. 1, the platform 2 is generally L-shaped with a substantially horizontal base portion 4 which can support the load of a wheelchair and a substantially vertical back wall 6. The base portion 4 comprises a floor on which the wheels of a chair can rest and side walls to guide the wheels laterally. Attached to the back wall 6 is a backrest and headrest assembly 7.

The platform 2 is pivotably connected between a pair of side supports 8. The pivot points 9 are positioned on the side panels 8 above the base wall of the platform 2 and in front of the back wall 6 of the platform 2. The platform 2 can therefore be tilted about an axis connecting the two pivot points 9.

The supporting side panels 8 are placed one on each side of the platform 2, extending from the back wall 6 along a portion of the length of the base 4. The side support panels 8 are connected beneath the platform 2 by a base plate 10 (seen in FIG. 3) that is smaller than the floor area of the platform base 4. The base plate 10 may comprise a sandwich construction of a wooden board between metal plates. The base plate 10 can be used to guide and hide electrical wires and hydraulic hoses.

The side supports 8 provide an anchor point for a pair of hydraulic actuators 12. The hydraulic actuators 12 act below the pivots 9. The ram of each hydraulic actuator 12 is operably connected to the back wall 6 of the platform 2 through a radial slot 14 in the side panel 8. The radial slots 14 define the extent of tilting motion available to the platform 2. When the platform is in the horizontal position, as is shown in FIG. 1, the rams of the actuators 12 are in their extended condition. The radial slots 14 are designed to give the base 4 a maximum tilting angle of 70° from the horizontal when the rams are retracted.

A front portion 16 of the platform base 4 is hinged so as to allow the platform 2 to be folded when not in use. The front portion 16 forms part of the load-bearing base 4 of the platform and in use the front wheels of a wheelchair will rest on the front portion 16. The front portion 16 is wider at the end remote from the hinge 18 to allow for easy access of wheelchairs from a range of angles. As is best seen from FIG. 3, the front portion 16 provides the base 4 with a flared profile so that a curved trajectory for access to the platform 2 is possible.

Sensitive strip switches 22 are attached to the upper edge of each side support panel 8. Should any person actuate these switches, whilst the platform 2 is being lowered, the platform 2 will immediately stop its motion and move upwards a short distance to release any person or object. Strip switches 22 mounted on the underside of the front and side edges of the hinged portion 16 of the platform base 4 also produce a similar action when operated. These switches 22 can therefore detect when an object is trapped below the platform 2.

When the platform 2 is in the loading position, the base 4 is generally horizontal but is inclined at a very slight angle downward from the back wall 6. The front edge of the base portion 4 does not rest on the floor so as to provide clearance for the strip sensors 22 mounted underneath. Feet (not shown) may be attached underneath the base 4 close to its front edge to ensure that the sensors 22 are kept at a minimum distance from the floor and do not trigger when the base 4 is lowered normally.

However the front portion 16 of the base 4 is still close enough to the floor that a wheelchair can be bumped up onto the base 4 to gain access to the platform 2.

The electrical system is based on 24V DC. This supply is normally taken from batteries contained within the platform 2, in a cavity within the back wall 6. The batteries (not shown) can be charged from a remote charger that may be plugged into the platform 2. Power may also be taken from a remote 24V supply such as a mains socket. A hydraulic pump is also provided in the cavity in the back wall 6. The hydraulic pump is operated on 24V with its direction of rotation determining the flow direction of the hydraulic fluid. The hydraulic actuators 12 are controlled by a programmable computer chip through relays on a circuit board 20 provided in one of the side panels 8. Control circuitry and hydraulic pipes pass underneath the platform 2 but are covered by the base plate 10 so that they do not trail on the floor.

The platform 1 is moved on retractable ball castor units 24 mounted at either end of the side panels 8 and at the corners of the base plate 10. The castors 24 are ejected to support the platform 1 by low pressure air supplied by a compressor 26 and retracted by dumping the compressed air using a switch 28. The compressor 26 and switch 28 are provided in one of the side panels 8. Pneumatic air supply lines pass beneath the platform 2 in the space covered by the base plate 10. There may be provided a plug connection to an external supply of compressed air, for example in a dental surgery.

Stability of the platform 1 is ensured by deploying two rear stabilisers 30. The stabilisers 30 are attached one to each side support panel 8 using a vertical axis hinged joint. For storage the stabilisers 30 can be rotated to a position behind the platform 2 (see FIG. 4*b*). A foot 32 is attached to each stabiliser 30 at its distal end to come into contact with the floor when the platform is lowered ready for use. As the stabilisers 30 fold across the back wall 6, they prevent any inadvertent tilting motion of the platform 2 until they have been extended rearwardly into position.

Figure 4A:
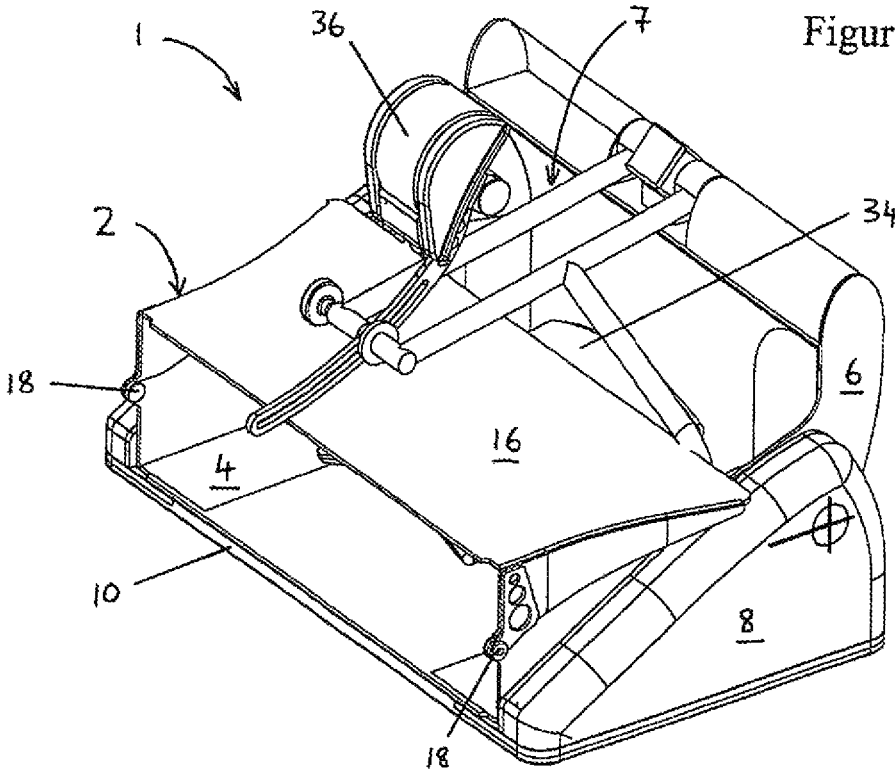
FIGS. 4*a* and 4*b* are perspective views of the wheelchair platform of the preferred embodiment in a folded configuration.
Figure 4B:
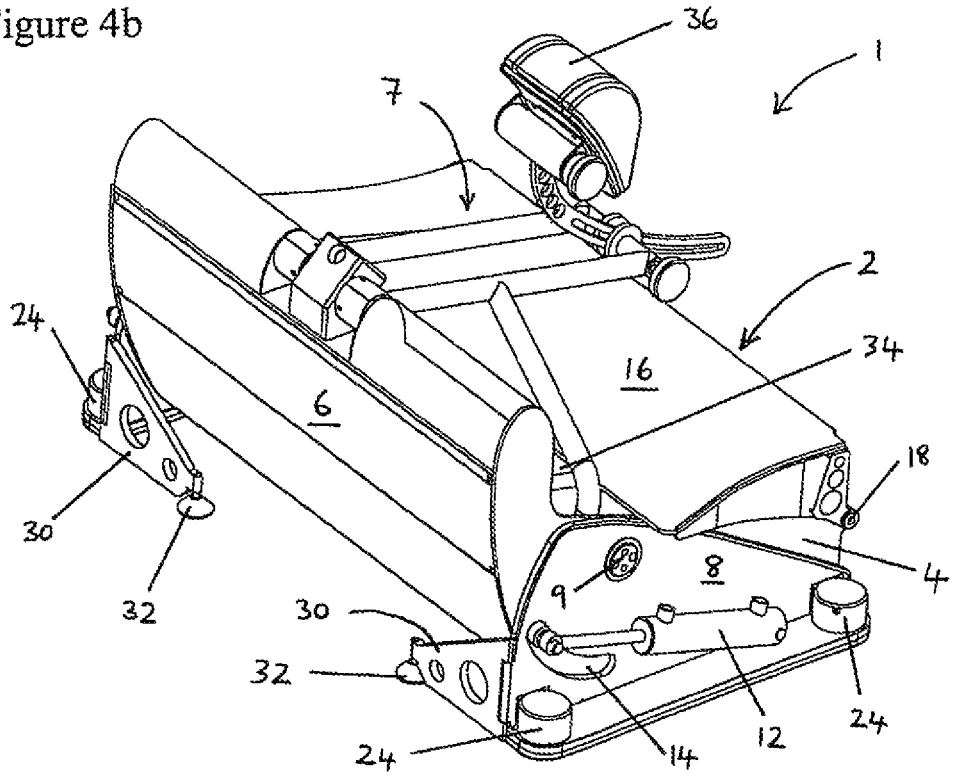

Turning to FIGS. 4*a* and 4*b*, it can be seen how the platform 1 is folded up when not in use. The front portion 16 of the platform base 4 is hinged along a line coinciding with the front, ends of the side panels 8. This allows the front portion 16 of the platform 2 to be rotated back so as to rest on the main portion of the platform base 4 between the side panels 8. The backrest and headrest assembly 7 can be pivoted about a horizontal axis where it is hingedly connected to the back wall 6 of the platform 2. This allows the assembly 7 to be lowered into a storage position. The back rest 34 conveniently fits down between the hinged portion 16 of the base 4 and the back wall 6. The head rest 36 is pivotally connected to the assembly 7 and can be folded back on top of the back rest 34. A very compact unit is thereby achieved, with all the components generally folded within the volume of the L-shaped platform 2.

Operation of the platform 1 will now be described with reference to FIGS. 1 to 3. The platform 1 is placed in its loading position shown in FIG. 1 by moving the platform 1 to a desired location on the castors 34. Next the rear stabilisers 30 are pulled round to the back of the platform 2. The castors 24 are retracted by releasing the pneumatics so as to lower the side supports 8 into contact with the floor. If the platform 1 was in its folded configuration (shown in FIG. 4) then the backrest and headrest assembly 7 is unfolded in its vertical configuration. The front portion 16 of the platform 4 is folded down. The apparatus is now ready for a wheelchair to be wheeled back onto the platform 2. The backrest and headrest assembly 7 can be adjusted to fit the wheelchair and user.

In order to tilt the platform 2 back, the hydraulic actuators 12 are activated using control switches (not shown). As the hydraulic rams retract into the cylinders, the connection point with the back wall 6 is pulled along the radial path of the slot 14. The back wall 6 of the platform 2 is therefore pulled forward and down in order to swing the base 4 of the platform 2 up from it horizontal position, as is shown in FIGS. 2 and 3. The wheelchair and user are tilted back with the platform 2 into reclined position of, say, 45° for normal dental procedures. The operator may select the angle of tilt or a number of presets may be available.

Figure 2:
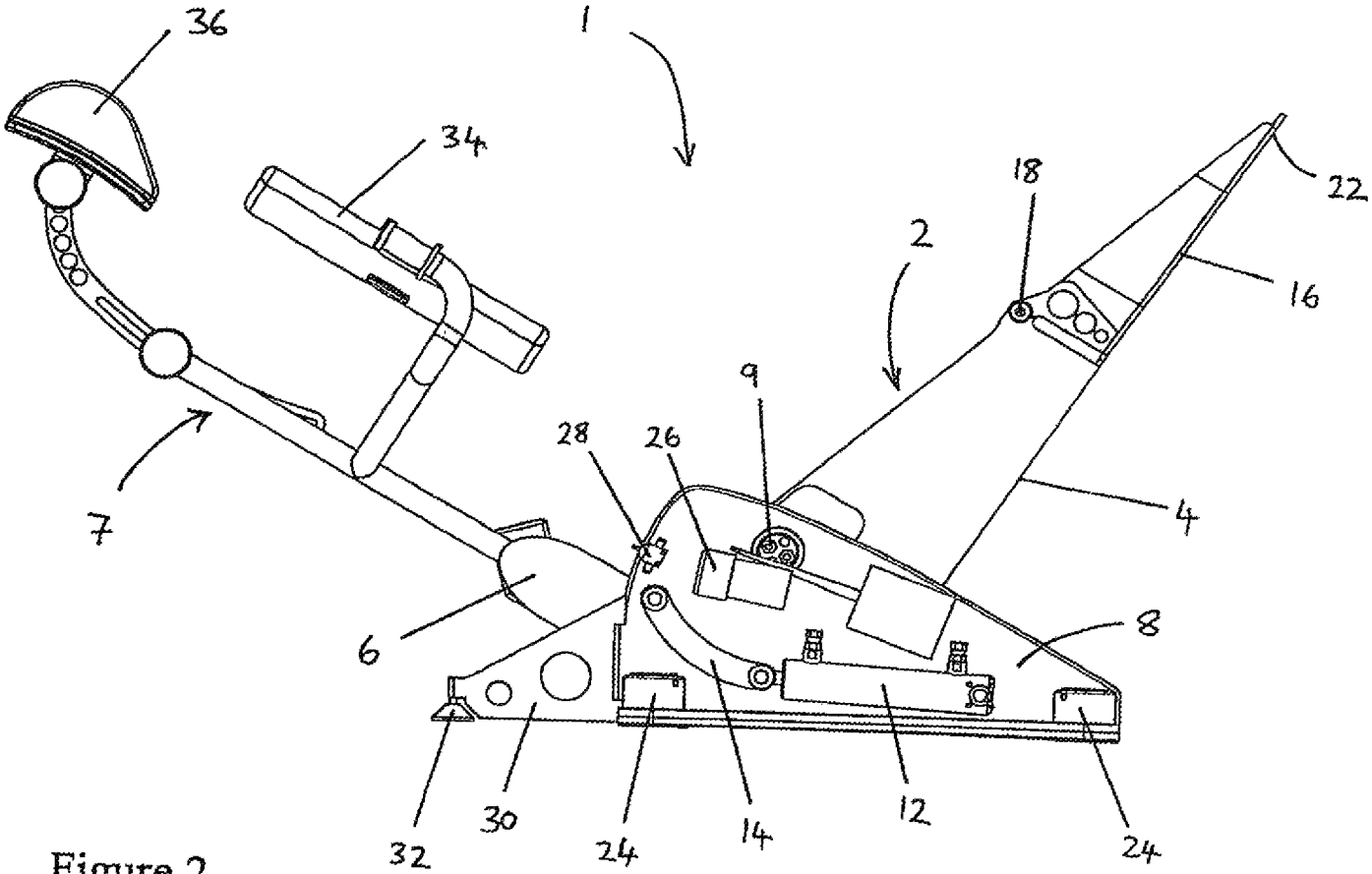
FIG. 2 is a side view of the wheelchair platform of FIG. 1 in a tilted position.
Figure 3:
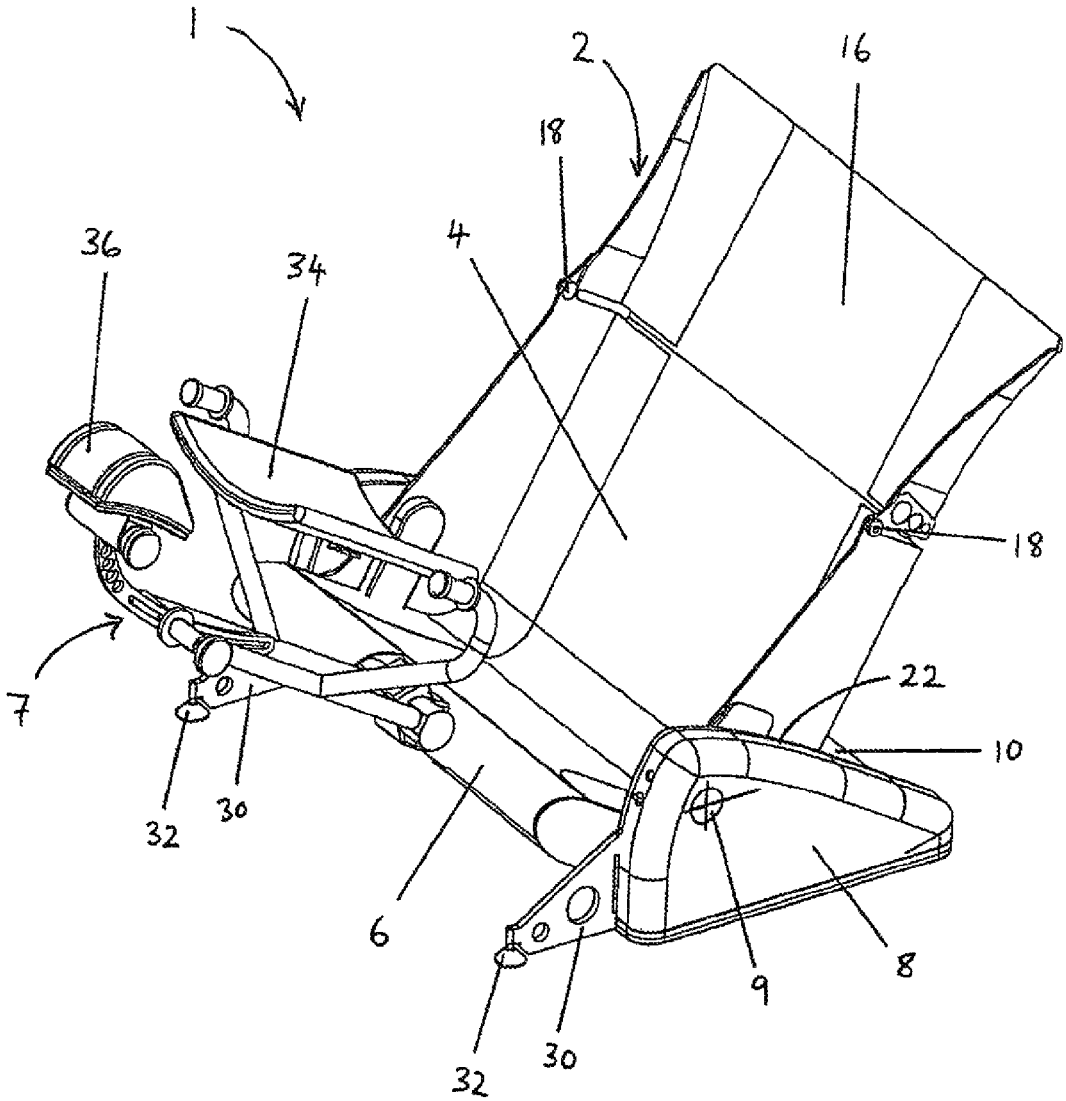
FIG. 3 is a perspective view of the wheelchair platform in the same position as in FIG. 2.

As will be appreciated from FIGS. 1 to 3, as the platform 2 is rotated about the axis between the pivot points 9 the weight of the patient and wheelchair are kept forward of the back wall 6 and may even be moved further forward as the platform 2 swings beneath the pivot. The tilting motion of the platform 2 therefore keeps the centre of gravity within a close range of the pivot points 9. The overall platform 1 is therefore very stable with the weight throughout operation being concentrated on the floor area between the side supports 8. The person in the wheelchair does not feel a large shift in this centre of gravity as he is tilted back, and can even move in the chair without feeling a disturbing effect.

Although the invention has been described with reference to a preferred embodiment, it will be understood by those skilled in the art that various modifications may be made without departing from the scope of the invention as defined by the accompanying claims.

The invention claimed is:

1. A wheelchair platform comprising a tilting platform for a wheelchair comprising a base to support the wheelchair in use and a back wall, said platform being pivotably connected between a pair of side supports, and an actuator operable to tilt the platform, wherein a pivot axis for the platform is forward of the back wall and above the base, and wherein the actuator is forward of the back wall, wherein the actuator constitutes a hydraulic actuator, and wherein the hydraulic actuator is arranged so as to move from an extended position when the platform is lowered to the floor to a retracted position when tilting the platform up from the floor.

2. A wheelchair platform as claimed in claim 1, wherein the pivot axis for the platform is positioned such that in use the centre of gravity of the tilting platform with its wheelchair load moves within a limited range laterally of the pivot axis.

3. A wheelchair platform as claimed in claim 1, wherein the platform base can be tilted by up to 45°, 50°, 60°, or 70° from the horizontal.

4. A wheelchair platform as claimed in claim 1, wherein the side supports do not extend behind the back wall of the platform.

5. A wheelchair platform as claimed in claim 1, wherein the side supports only extend along a portion of the base which is about 30%, 40%, 50%, 60% or 70% of the length of the base.

6. A wheelchair platform as claimed in claim 1, wherein the actuator is positioned at the side(s) of the platform.

7. A wheelchair platform as claimed in claim 1, wherein there is provided a pair of actuators, one at or in each of the side supports.

8. A wheelchair platform as claimed in claim 1, wherein the actuator is operably connected to the back wall of the platform.

9. A wheelchair platform as claimed in claim 1, further comprising one or more retractable stabilizers connected at the rear of the side supports.

10. A wheelchair platform as claimed in claim 1, wherein the wheelchair platform is mobile.

11. A wheelchair platform as claimed in claim 1, wherein at least a portion of the base of the tilting platform which supports the wheelchair in use is hinged so as to allow the platform to be folded when not in use.

12. A wheelchair platform as claimed claim 1, wherein the hydraulic actuator is located forward of the back wall of the platform and below the pivot axis of the platform.

13. A wheelchair platform comprising a tilting platform for a wheelchair, said platform being pivotably connected between a pair of side supports, and an hydraulic actuator operably connected to the platform such the platform is tilted about a pivot axis up from a horizontal position when a ram of the actuator is retracted from an extended position, wherein the hydraulic actuator is located forward of a back wall of the platform and below the pivot axis of the platform.

* * * * *